US011181237B2

(12) United States Patent
Sears

(10) Patent No.: US 11,181,237 B2
(45) Date of Patent: Nov. 23, 2021

(54) UNIVERSAL CRYOGENIC GAS MANIFOLD

(71) Applicant: Garry Lee Sears, Bolivar, OH (US)

(72) Inventor: Garry Lee Sears, Bolivar, OH (US)

( * ) Notice: Subject to any disclaimer, the term of this patent is extended or adjusted under 35 U.S.C. 154(b) by 381 days.

(21) Appl. No.: 15/920,683

(22) Filed: Mar. 14, 2018

(65) Prior Publication Data

US 2019/0285228 A1 Sep. 19, 2019

(51) Int. Cl.
*F17C 13/04* (2006.01)
*F17C 9/02* (2006.01)

(52) U.S. Cl.
CPC ..... *F17C 13/04* (2013.01); *F17C 9/02* (2013.01); *F17C 2227/0107* (2013.01); *F17C 2250/03* (2013.01)

(58) Field of Classification Search
CPC .. F17C 13/04; F17C 13/02; F17C 9/02; F17C 2250/03; F17C 2227/0107
See application file for complete search history.

(56) References Cited

U.S. PATENT DOCUMENTS

2008/0276998 A1* 11/2008 Boyher ..... E03C 1/023 137/561 A
2015/0233528 A1* 8/2015 Macaluso ..... F17C 7/00 141/11

* cited by examiner

*Primary Examiner* — Brian M King
(74) *Attorney, Agent, or Firm* — Renner, Kenner, Greive, Bobak, Taylor & Weber Co., L.P.A.

(57) ABSTRACT

A cryogenic gas manifold for use in a cryogenic gas system includes first and second interchangeable tubular headers. Each of the tubular headers has a nipple for receiving cryogenic gas from a source or for providing such cryogenic gas to a user. Each of the tubular headers has opposed branch nipples for threadedly receiving devices that interconnect at least certain of the branch nipples of the pair of tubular headers. This interconnection is by threaded engagement of at least certain devices such as regulators, valves, gauges, sensors, bypass valves, low-temperature shutoff valves, and the like. The interconnection of these various devices with the pair of headers establishes a structural integrity for the manifold. Feet may be clamped to the bottom of each of the headers to allow the manifold to be freestanding. The threaded engagement of all of the various elements makes the manifold cost-effective.

16 Claims, 4 Drawing Sheets

UNIVERSAL CRYOGENIC GAS MANIFOLD

FIELD OF THE INVENTION

The invention herein resides in the art of cryogenic gas distribution systems and, more particularly, to a manifold for such systems adapted for interconnection between a gas source and an end user. More specifically, the invention relates to a universal manifold for such systems that accommodates a multiplicity of valves, meters, regulators, and sensors in such a manner as to readily tailor the interconnection from the gas source to the end user with state-of-the-art equipment and which accommodates ease of dismantling or modification when such use changes or is no longer required.

BACKGROUND OF THE INVENTION

The instant invention deals with the transportation and distribution of industrial and/or medical gases from a bulk tank or source to an end user. By way of example, and as shown in FIG. 1, a cryogenic gas system of the type relevant to the instant invention is designated generally by the numeral 10. The system 10 includes a storage tank 12 for the bulk storage of a cryogenic liquid. The liquid is passed through a conduit 14 to a vaporizer 16, where the liquid is vaporized and converted to a gaseous form and passed through the conduit 18 to a manifold 20. The manifold 20 will include valves, regulators, and the like to control the pressure of the gas to be delivered through the conduit 22 to an end user 24. The manifold 20 includes not only pressure regulators to control the delivered pressure of the gas, but also may include low temperature protection that closes the regulator to preclude the further flow of gas in the event the gas temperature drops below a particular level, typically on the order of −10° F. to −40° F.

With reference to FIG. 2, a prior art manifold for cryogenic gas systems is designated generally by the numeral 20A. The manifold system is mounted upon a pair of side posts 26 having feet 28 extending laterally from each side thereof. The manifold itself includes an inlet valve 30 and an outlet valve 32, which may also have relief valves associated therewith. A pair of pressure regulators 34 is shown in parallel connection with each other, the branches or legs of the manifold maintaining the pressure regulators in isolation from each other and from the manifold proper by means of isolation valves 36, 38 and 40, 42 on either side of the associated pressure regulators 34.

As shown, the manifold 20A is formed from a matrix of interconnected pipes that are sweat-fit and/or threadedly interconnected with each other, with their various valves, gauges, regulators, and the like being appropriately interconnected within the matrix. This matrix of interconnected pipes 44 is then mounted to the side posts 26 by means of brackets and the like. Notably, the side posts 26 are totally passive, serving no other function than to support the matrix of pipes, valves, gauges, regulators, monitors, and the like.

Prior art manifolds, such as the manifold 20A, are typically location and utilization specific, being constructed for a specific adaptation and not given to reuse or subsequent adaptation for use in other cryogenic gas systems. It is not only costly to construct the manifold 20A of the prior art, but it is also costly in that any subsequent use, apart from the peculiarly adapted cryogenic gas system, is substantially impossible such that, upon dismantling of the cryogenic gas system, the manifold is typically discarded.

SUMMARY OF THE INVENTION

In light of the foregoing, it is a first aspect of the invention to provide a cryogenic gas manifold that does not rely upon the use of support stands serving no other purpose than supporting the manifold.

Yet another aspect of the invention is the provision of a cryogenic gas manifold that is adaptable to any of numerous cryogenic gas systems.

Yet a further aspect of the invention is the provision of a cryogenic gas manifold in which the stand itself provides conduits for the cryogenic gas handled by the system.

Still a further aspect of the invention is the provision of a cryogenic gas manifold that can be quickly and easily constructed while employing any of various commonly available valves, regulators, sensors, gauges, and the like.

Yet an additional aspect of the invention is the provision of a cryogenic gas manifold that is easy to assemble, disassemble, transport, and implement in a cryogenic gas system of any of various natures.

The foregoing and other aspects of the invention which will become apparent as the detailed description proceeds are achieved by a cryogenic gas manifold, comprising first and second tubular headers; said first tubular header having an input nipple extending from a side thereof; said second tubular header having an output nipple extending from a side thereof; and said first and second tubular headers each having a plurality of branch nipples extending from sides thereof.

Yet further aspects of the invention are attained by a cryogenic gas manifold interposed between a cryogenic gas source and a user of such gas, comprising first and second interchangeable tubular headers; each said tubular header having a nipple for receiving cryogenic gas from said source or providing it to the user; each said tubular header having opposed branch nipples; and devices interconnecting at least certain of said branch nipples of said first and second tubular headers with each other, said interconnection being by threaded engagement of at least certain of said devices with certain of said branch nipples.

BRIEF DESCRIPTION OF THE DRAWINGS

For a complete understanding of the various aspects of the invention, reference should be made to the following detailed description and accompanying drawings wherein.

BEST MODE FOR CARRYING OUT THE INVENTION

Figure 3A:
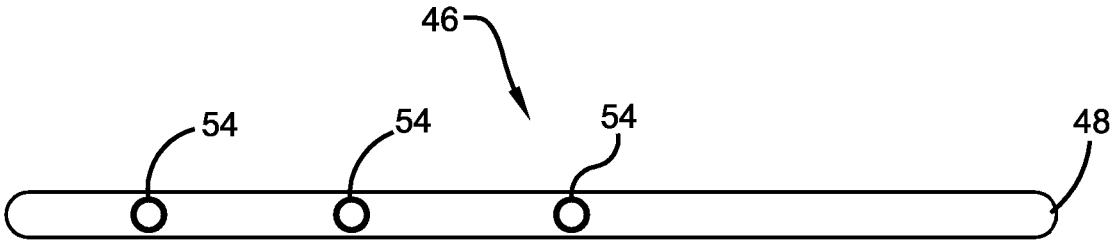
FIG. 3, comprising FIGS. 3A, 3B, and 3C respectively, shows a top plan view, side elevation view, and bottom plan view of the headers employed in association with the concept of the invention.
Figure 3B:
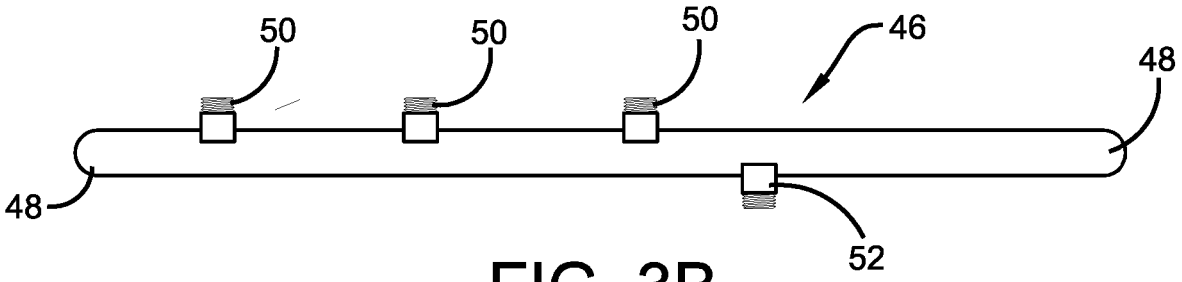
Figure 3C:
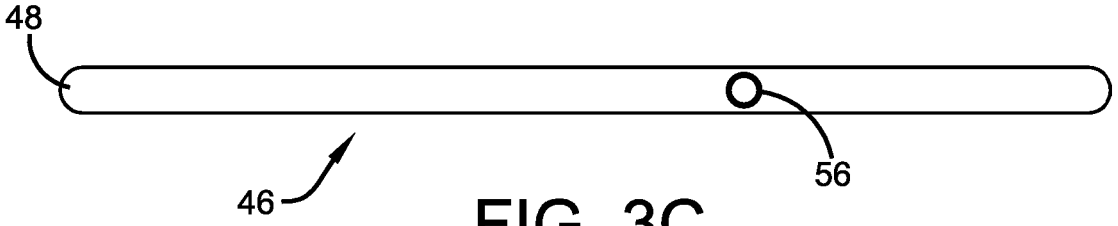

With reference to FIG. 3, an appreciation can be obtained as to the structure of the basic building block of the cryogenic gas manifold of the invention. As shown, a hollow header pipe 46 is sealed at both ends by caps 48. Preferably, the header pipe 46 is of a stainless steel or other suitable metal construction, and the caps 48 are welded thereto. It will be appreciated that the invention also contemplates the use of high-strength composite materials for the pipes and caps, as well.

The header pipe 46 includes a plurality of branch nipples or ports 50 and an inlet/outlet nipple or port 52 as shown. The nipples 50, 52 are preferably externally threaded and define apertures 54 for the branch nipples 50 and an aperture 56 for the inlet/outlet nipple 52.

Figure 1:
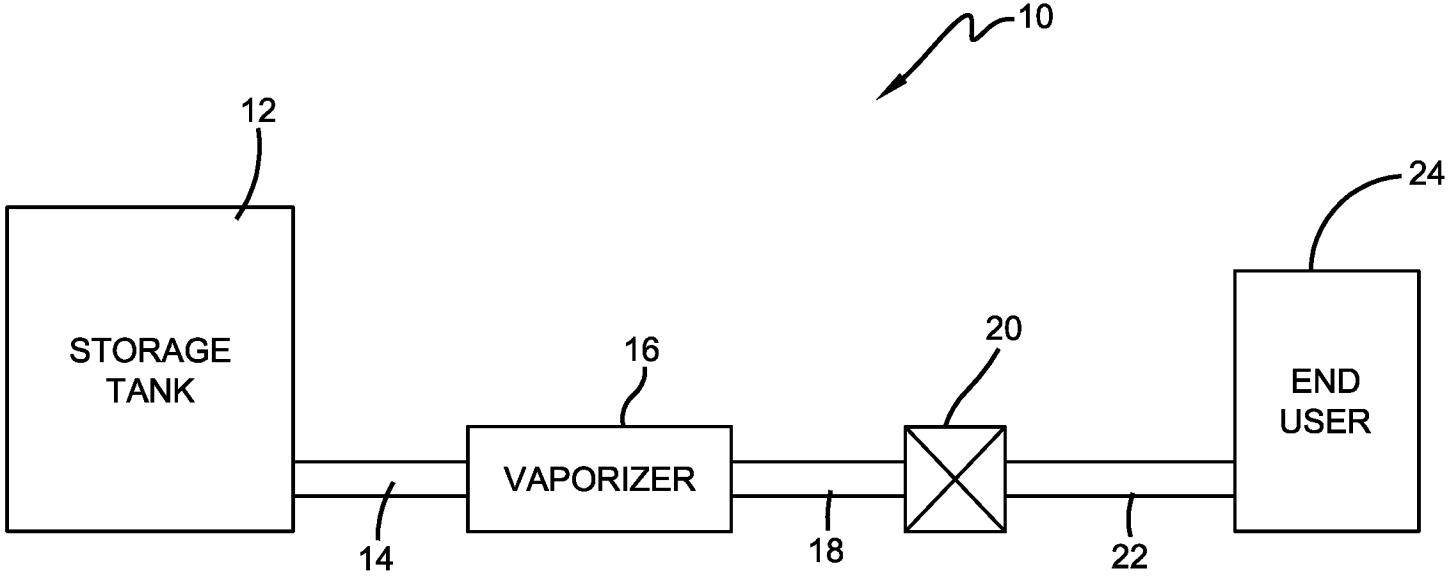
FIG. 1 is a system block diagram of a cryogenic gas system.
Figure 2:
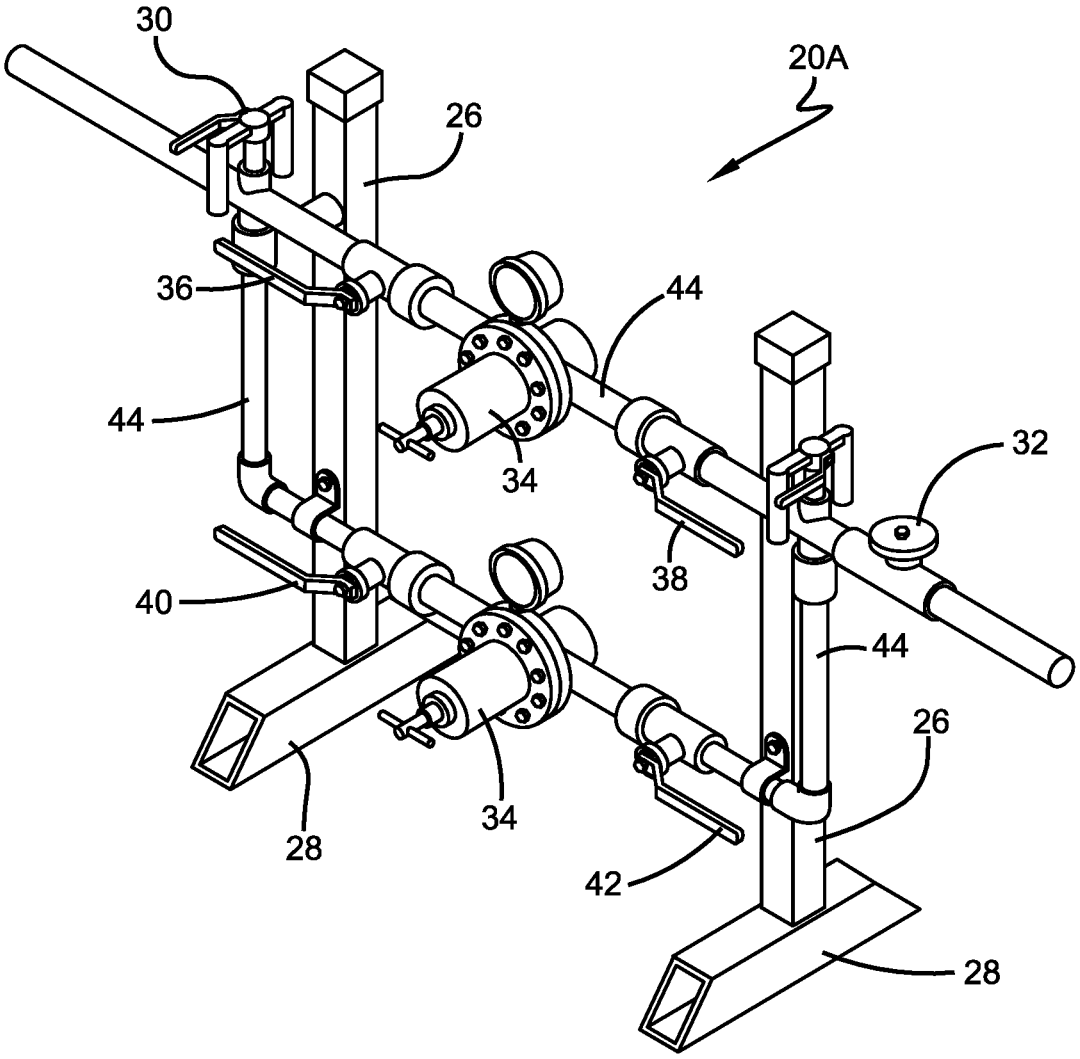
FIG. 2 PRIOR ART
FIG. 2 is a perspective view of a cryogenic gas manifold of the prior art as the same would typically be used in a cryogenic gas system.
Figure 4:
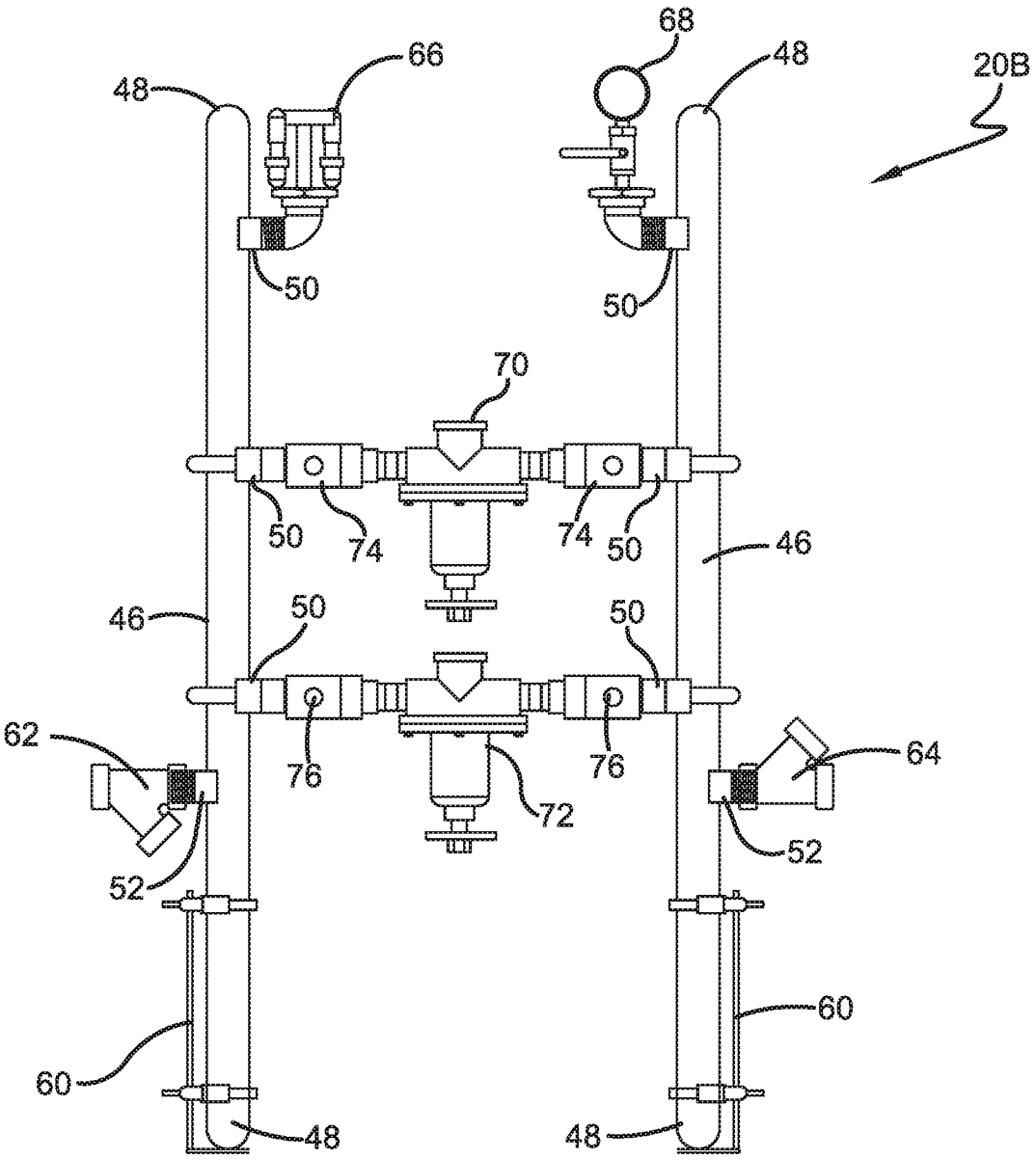
FIG. 4 shows the structure of a cryogenic gas manifold of the invention, implementing the headers of FIG. 3, and showing the same in use with various devices for monitoring, regulating, and controlling the flow of cryogenic gas through the header.

With reference now to FIG. 4, it can be seen that a pair of header pipes 46 may be employed to construct the cryogenic gas manifold 20B of the invention for use in place of the manifold 20 in the system 10 of FIG. 1. Each pair of header pipes 46 may be provided with a foot clamp 60, providing feet for the header pipes 46 that extend both fore and aft of the pipes and are adapted for engagement with a horizontal surface such as the ground, a floor, or the like. An inlet 62 from a vaporizer or the like is threadedly connected to the inlet nipple 52, while an outlet 64 is similarly threadedly connected to the outlet nipple 52 for interconnection with the end user. Those skilled in the art will appreciate that the inlets and outlets 62, 64 are appropriately connected by piping or the like for interconnection with the vaporizer and end user, respectively.

The branch nipples 50 are also populated to finish the construction of the cryogenic gas manifold 20B. A relief valve 66 may be connected to a branch nipple 50 on the inlet side of the manifold as shown. A valve with an associated pressure gauge 68 may be threadedly connected to an associated branch nipple of the header pipe 46 on the outlet side of the manifold. According to the embodiment shown, devices 70, 72 are interconnected between opposite pairs of the threaded nipples 50 between the inlet header pipe 46 and the outlet header pipe 46, as shown. According to an embodiment of the invention, these devices may comprise a pair of redundant pressure regulators connected in parallel between the inlet side and outlet side of the manifold 20B, or they may include combinations of regulators, bypass valves, low-temperature shutoff valves, and the like, depending upon the needs of the associated cryogenic gas system. For example, various combinations 74, 76 of manual valves, couplers, connectors, regulators and the like may be employed between the threaded nipples of opposite header pipes 46 to achieve any of numerous manifold configurations. It is contemplated that the devices are typically threadedly connected, allowing for ease of assembly and disassembly. The manifold 20B is self-contained between the system inlet 62 and outlet 64 as at the nipples 52. It includes branch nipples 50 that are oppositely paired to accommodate any of numerous elements therebetween. The stand, comprised of header pipes 46, is an active stand, serving as a gas conduit to the various valves, regulators, monitors and the like. Moreover, the manifold 20B can be freestanding, as accommodated by the foot clamps 60.

The resulting cryogenic gas manifold 20B is not only active as compared to the prior art passive manifold stands, but it is also given to ease of assembly and disassembly, modification, and the like. Accordingly, the cryogenic gas manifold 20B of the invention is cost effective, not only from the implementation of a single design of header pipe, but also from the ease by which it can accommodate state-of-the-art gauges, monitors, valves, reducers, temperature shutoff valves, pressure regulators, and the like.

Thus it can be seen that the various aspects of the invention have been satisfied by the structure presented hereinabove. While in accordance with the patent statues only the best known and preferred embodiment of the invention has been presented and described in detail, the invention is not limited thereto or thereby. Accordingly, for an appreciation of the scope and breadth of the invention, reference should be made to the following claims.

What is claimed is:

1. A cryogenic gas manifold, comprising:

first and second tubular headers, each of said tubular headers being sealed closed at opposite ends thereof;

said first tubular header having an input nipple extending therefrom;

said second tubular header having an output nipple extending therefrom;

said first and second tubular headers each having a plurality of branch nipples extending from sides thereof; and each of said first and second tubular headers having a foot clamped to a bottom end thereof.

2. The cryogenic gas manifold as recited in claim 1, wherein each said nipple defines an aperture and port in communication with a hollow interior of the first or second tubular header from which said nipple extends.

3. The cryogenic gas manifold as recited in claim 2, wherein devices are interconnected with at least certain of said branch nipples.

4. The cryogenic gas manifold as recited in claim 3, wherein certain of said devices are interposed between selected pairs of said branch nipples between said first and second tubular headers.

5. The cryogenic gas manifold as recited in claim 4, wherein certain other of said devices are singularly connected to a branch nipple of only one of said first and second tubular headers.

6. The cryogenic gas manifold as recited in claim 4, wherein multiple pairs of said devices are interconnected in parallel between multiple selected pairs of said branch nipples of each of said first and second tubular headers.

7. The cryogenic gas manifold as recited in claim 4, wherein said devices are taken from the group of regulators, valves, gauges, sensors, low-temperature shutoff valves, and bypass valves.

8. The cryogenic gas manifold as recited in claim 4, wherein said first and second tubular headers are interchangeable.

9. The cryogenic gas manifold as recited in claim 8, wherein said first and second tubular headers each have the same number of nipples.

10. The cryogenic gas manifold as recited in claim 9, wherein each of said first and second tubular headers has a nipple that can serve equally as an input nipple and an output nipple.

11. The cryogenic gas manifold as recited in claim 10, wherein said input nipple is in communication with a source of cryogenic gas and said output nipple is in communication with a user of said cryogenic gas.

12. The cryogenic gas manifold as recited in claim 4, wherein said devices are threadedly connected to and disconnectable from said nipples.

13. The cryogenic gas manifold as recited in claim 4, wherein said headers are of stainless steel construction.

14. A cryogenic gas manifold interposed between a cryogenic gas source and a user of such gas, comprising:

first and second interchangeable tubular headers, each of said first and second interchangeable tubular headers being sealed closed at opposite ends thereof;

each said tubular header having a nipple for receiving cryogenic gas from said source or providing it to the user;

each said tubular header having opposed branch nipples;

devices interconnecting at least certain of said branch nipples of said first and second tubular headers with each other, said interconnection being by threaded engagement of at least certain of said devices with certain of said branch nipples; and each of said first and second tubular headers having a foot attached to a bottom end thereof.

15. The cryogenic gas manifold as recited in claim 14, wherein said certain devices are taken from the group of regulators and valves.

16. The cryogenic gas manifold as recited in claim 15, wherein said nipples and branch nipples establish ports for passage of said cryogenic gas from a source, through said first tubular header, through said certain devices, and thence through said second tubular header and to the user.

* * * * *